US008959771B2

(12) United States Patent
Sutherland

(10) Patent No.: US 8,959,771 B2
(45) Date of Patent: Feb. 24, 2015

(54) METHOD OF CONSTRUCTING A SHELL FOR A ROOM AIR CONDITIONER/HEAT PUMP WITH LATERAL STRENGTH

(75) Inventor: Joe B. Sutherland, San Antonio, TX (US)

(73) Assignee: Friedrich Air Conditioning Co., Ltd.

( * ) Notice: Subject to any disclaimer, the term of this patent is extended or adjusted under 35 U.S.C. 154(b) by 847 days.

(21) Appl. No.: 13/222,728

(22) Filed: Aug. 31, 2011

(65) Prior Publication Data

US 2013/0047689 A1 Feb. 28, 2013

(51) Int. Cl.

| | |
|---|---|
| ***B23P 11/00*** | (2006.01) |
| ***B21D 39/03*** | (2006.01) |
| ***B21D 51/06*** | (2006.01) |
| ***F24H 9/02*** | (2006.01) |
| ***B21D 51/52*** | (2006.01) |

(52) U.S. Cl.

CPC ..... *B21D 39/03* (2013.01); *B21D 51/52* (2013.01); *F24H 9/02* (2013.01)

USPC ..... 29/890.035; 29/515; 29/525.11; 29/525.13; 72/379.4

(58) Field of Classification Search

CPC ..... B21D 5/00; B21D 11/10; B21D 11/20; B21D 31/005; B21D 31/02; B21D 35/001; B21D 35/002; B21D 39/03; B21D 39/031; B21D 51/06; B21D 51/52; B23P 11/00; F24H 9/02

USPC ..... 29/890.035, 890.039, 515, 525.11, 29/525.13; 72/46, 379.4, 379.2; 30/366–368

See application file for complete search history.

(56) References Cited

U.S. PATENT DOCUMENTS

| | | | | |
|---|---|---|---|---|
| 318,221 | A | 5/1885 | Thompson et al. | |
| 1,675,910 | A | 7/1928 | Riker | |
| 1,926,686 | A * | 9/1933 | Newton | 29/525.11 |
| 2,161,969 | A | 6/1939 | Mange | |
| 2,169,056 | A | 8/1939 | Place | |
| 2,400,412 | A | 5/1946 | Hawn et al. | |
| 2,627,766 | A | 2/1953 | Marchant | |
| 2,701,018 | A | 2/1955 | Glitsch | |
| 2,738,575 | A | 3/1956 | Swain et al. | |
| 2,897,035 | A | 7/1959 | Dorsey | |
| 2,928,450 | A | 3/1960 | Belding | |
| 3,010,207 | A | 11/1961 | Barnes | |
| 3,156,152 | A | 11/1964 | Reed | |
| 3,357,763 | A * | 12/1967 | Toper | 312/236 |

(Continued)

FOREIGN PATENT DOCUMENTS

| | | |
|---|---|---|
| JP | 60-096328 | 5/1985 |
| JP | 03-189020 | 8/1991 |

*Primary Examiner* — Alexander P Taousakis
*Assistant Examiner* — Matthew P Travers
(74) *Attorney, Agent, or Firm* — Gunn, Lee & Cave, P.C.

(57) ABSTRACT

A method of manufacturing a shell from sheet metal for a room air conditioner/heat pump is shown. The sheet metal is stamped and formed to a U-shaped rectangular shell with open ends and a shell brace. Flanges on the outer edge of the U-shaped rectangular shell overlap at corners with (a) adjacent flanges or (b) the shell brace. Both the U-shaped rectangular shell and shell brace are inserted into an assembly machine where the corners are clinched and punched. The outermost flange at each corner is punched to a fixed diameter, but the innermost flange or the shell brace is only punched to a conical shape. Screws are inserted at each corner that pass through the fixed diameter to threadably engage only the conical shape of the innermost flange or shell brace.

17 Claims, 10 Drawing Sheets

(56) References Cited

U.S. PATENT DOCUMENTS

| | | | | |
|---|---|---|---|---|
| 3,403,437 | A | | 10/1968 | Jaworski |
| 3,429,171 | A | | 2/1969 | Feher |
| 3,494,431 | A | | 2/1970 | Yoho et al. |
| 3,777,399 | A | | 12/1973 | Rockel |
| 4,040,694 | A | | 8/1977 | Lascarrou |
| 4,087,912 | A | | 5/1978 | Granone |
| 4,176,441 | A | | 12/1979 | Hafner |
| 4,184,396 | A | | 1/1980 | Hafner |
| 4,192,431 | A | * | 3/1980 | Brown ..... 220/62 |
| 4,306,511 | A | | 12/1981 | Ashby et al. |
| 4,609,801 | A | | 9/1986 | Spencer et al. |
| 4,611,381 | A | | 9/1986 | La Barge et al. |
| 4,688,316 | A | | 8/1987 | La Barge et al. |
| 4,788,395 | A | | 11/1988 | Sakoda |
| 4,836,705 | A | | 6/1989 | La Barge et al. |
| 4,858,289 | A | | 8/1989 | Speller, Sr. |
| 4,888,460 | A | | 12/1989 | Oya |
| 5,022,253 | A | | 6/1991 | Parlatore |
| 5,067,228 | A | | 11/1991 | Gardenier |
| 5,638,693 | A | | 6/1997 | Baek |
| 5,642,641 | A | | 7/1997 | Maxfield, Jr. et al. |
| 5,798,185 | A | | 8/1998 | Kato |
| 5,943,873 | A | | 8/1999 | Chung |
| 6,106,184 | A | | 8/2000 | Daniels et al. |
| 6,109,086 | A | | 8/2000 | Gambrel et al. |
| 6,862,790 | B2 | | 3/2005 | Kato |
| 6,929,227 | B2 | | 8/2005 | Hofmann et al. |
| 7,168,259 | B2 | | 1/2007 | Yoon |
| 7,578,055 | B2 | | 8/2009 | Rapp |

* cited by examiner

METHOD OF CONSTRUCTING A SHELL FOR A ROOM AIR CONDITIONER/HEAT PUMP WITH LATERAL STRENGTH

BACKGROUND OF THE INVENTION

1. Field of the Invention

The present invention relates to a method of constructing a shell for a room air conditioner/heat pump that has good lateral strength and, more particularly, to the method of punching holes at each corner so that a screw inserted in the punched hole passes through the outermost sheet metal only to readably engage the innermost sheet metal at each corner, which screw provides lateral strength to the shell.

2. Description of the Prior Art

Housings for room air conditioners/heat pumps have been inserted inside of windows or openings in buildings for some time. Thereafter, the room air conditioner/heat pump would be positioned in the housing. In the past, a housing that encloses the air conditioner/heat pump except on each end would be used with vents or louvers as needed to allow air to pass there through. As time passed, and manufacturing capabilities increased, the housing became a shell that was formed from stamped sheet metal with open ends. The sheet metal would be stamped to a predetermined size and configuration complete with holes, louvers and notches therein.

The stamped sheet metal would then be formed to the desired shape to make a shell, which shell was held together by clinching. The shell may be either a full rectangular box with open ends or a U-shaped rectangular box with open ends and a shell brace across one open end. The shell would then be mounted in a window or an opening in the wall. Afterwards, the air conditioner/heat pump would be inserted in the shell.

The typical way the shell would be held together would be by clinching or by welding. However, a clinched shell has very little lateral strength. If any force is exerted laterally on the sides of the shell, the clenched corners have a tendency to break. If the breakage occurs during shipment, the shell would have to be replaced by the manufacturer. The replacing of the shells is very expensive.

One option to give lateral strength to the shell would be to insert screws in each corner of the shell. However, this would require screw holes to be formed in the shell at the time of stamping and after folding for the screw holes to line up. Normally, because of tolerances in the folding of the sheet metal, the screw holes do not line up. Further, if the screw is threaded into two pieces of sheet metal, there is a tendency for space to form between the two pieces of sheet metal, thereby decreasing the strength of the screw connection.

The reason for the space is because the screw will not threadably engage both pieces of sheet metal at the same time. Threadably engaging a first piece of sheet metal tends to draw the first piece along the screw and away from the second piece of sheet metal.

In the prior art, there are many different examples of screws joining two pieces of sheet metal, such as shown in U.S. Pat. No. 3,156,152 to Reed. However, as can be seen in FIG. 4 of Reed, the thread 20 threadably connects to both superimposed metal sheets 30 and 32. This has a tendency to form space between the metal sheets 30 and 32, which decreases the strength of the connection. Many times in the past, the screw would be threadably connected to both pieces of overlapping sheet metal with the result being that someone would have to forcibly attempt to draw the two pieces of sheet metal together.

An example of a way to form an appliance housing is shown in U.S. Pat. No. 2,897,035 to Dorsey. As can be seen in the figures, preformed socket 32 has to align with knob 17 having a center 28 therein. Thereafter, sheet metal screw 33 has to self-tap into multiple layers of sheet metal.

None of the prior art shows two overlapping pieces of sheet metal that form a housing, and after being formed, is punched with the outermost sheet metal receiving a screw there through without a threadable connection, but threadably connecting to an innermost sheet metal to draw the two pieces of sheet metal together. Such a connection is not shown in the prior art.

SUMMARY OF THE INVENTION

It's an object of the present invention to provide a shell that has good lateral strength.

It is a further object of the present invention to provide a shell for a room air conditioner/heat pump with screws in the corners of the shell to provide lateral strength.

It is a further object of the present invention to provide a method of manufacturing a shell for a room air conditioner/heat pump that has good lateral strength.

It is yet another object of the present invention to provide an apparatus and method for punching corners of a shell, wherein a screw inserted in the punched hole threadably engages only the innermost sheet metal.

It is still another object of the present invention to provide a method of manufacturing a shell wherein a piece of sheet metal is stamped to a predetermined shape with holes and louvers therein. The stamped sheet metal is then folded to form a U-shaped rectangular shell with open ends and having a shell brace across the open portion of the U-shaped rectangular shell. The U-shaped rectangular shell is then inserted into an assembly machine which clinches overlapping flanges together and punches screw holes therein. The screw holes are punched so that the screw does not threadably engage the outer sheet metal, but only threadably engages the internal sheet metal.

It is another object of the present invention to provide a method of punching multiple layers of sheet metal so that a screw inserted through the punched hole only engages the innermost sheet metal but not the outermost sheet metal, to draw the two pieces of sheet metal into tight layered contact with each other.

In practicing the present invention, the piece of sheet metal is stamped to a predetermined shape. During the stamping, holes and louvers are formed in the stamped blank. Thereafter, the stamped blank is folded to a generally U-shaped rectangular shell with open ends having overlapping flanges and corners of the U-shaped rectangular shell. A shell brace is also stamped and formed prior to being located across the opened side of the U-shaped rectangle.

Both the U-shaped rectangular shell and the shell brace are placed in an assembly machine that will clinch each corner of the U-shaped rectangular shell to form an open-ended box. Also, the assembly machine will punch holes (a) in the overlapping flanges at each corner or (b) in overlapping flanges and shell brace. The punched holes are of a predetermined shape so that when the shell is removed from the assembly machine and screws are inserted in the punched holes, the screws will not engage the outermost flange, but will only engage the innermost flange or shell brace. The threaded engagement of the innermost flange or shell brace, but not the outermost flange, is determined by the shape and depth of the punch operating against a die.

DESCRIPTION OF THE PREFERRED EMBODIMENT

Figure 1:
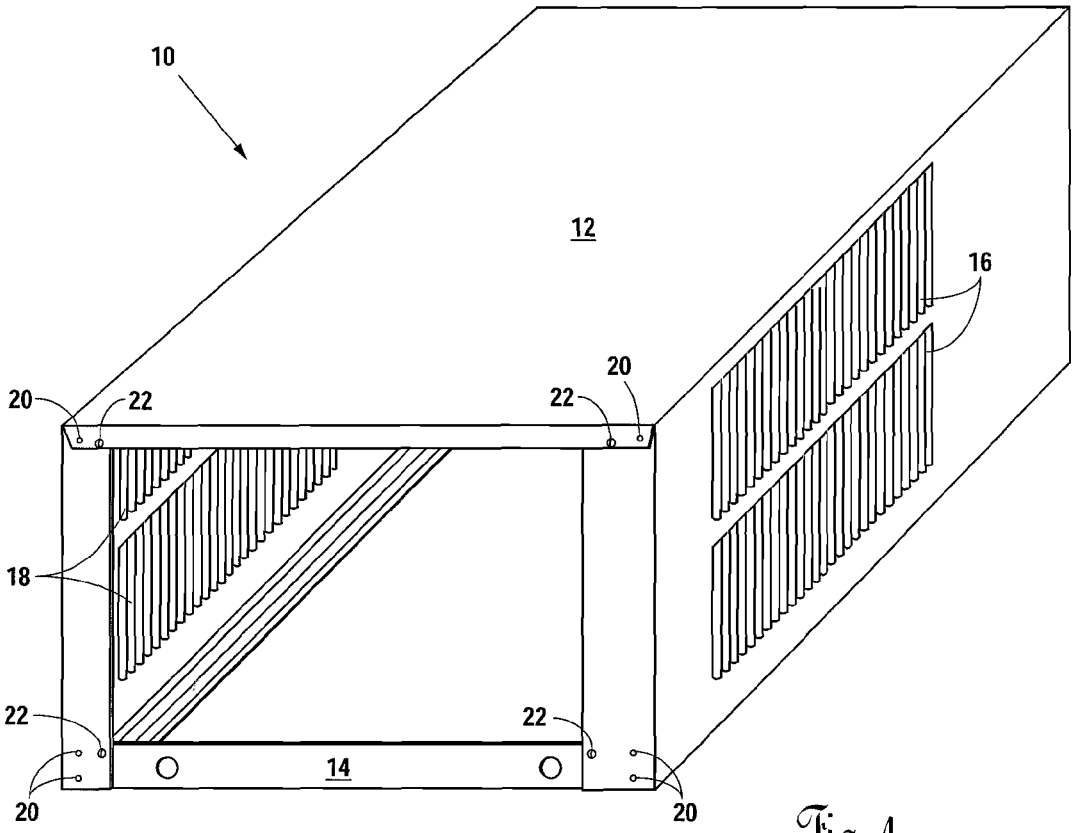
FIG. 1 is a perspective view of a shell for a room air conditioner/heat pump.

Referring to FIG. 1, a perspective view of a shell 10 for a room air conditioner and/or heat pump is shown. The shell 10 includes a U-shaped rectangular shell 12 with a shell brace 14 connecting between the corners of an open end of the U-shaped rectangular shell. Louvers 16 and 18 are located on each side of the U-shaped rectangular shell 12.

As will be explained in more detail subsequently, at the time of assembly, clinching indentations 20 are made in each corner of the shell 10. Also to give lateral support, screws 22 are inserted in holes punched in shell 10 in a manner as will be subsequently described.

Figure 2:
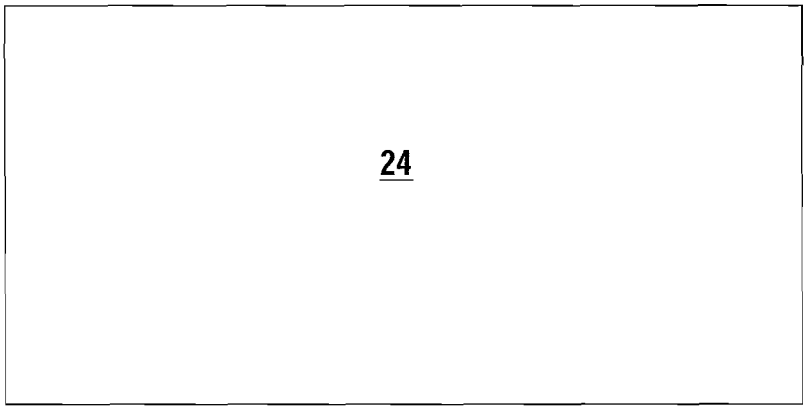
FIG. 2 is a blank of sheet metal.
Figure 3:
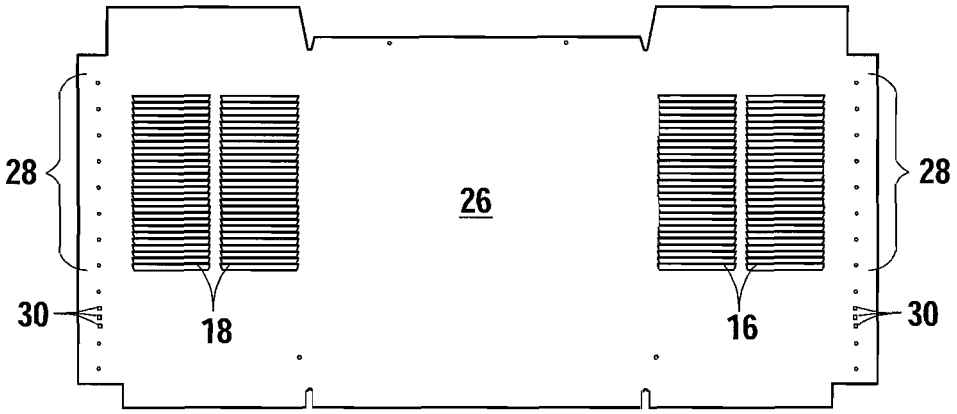
FIG. 3 is a stamped blank of sheet metal for a room air conditioner/heat pump.

Referring to FIG. 2, a blank piece of sheet metal 24 is shown. The blank piece of sheet metal 24 is stamped to form a stamped blank 26 as shown in FIG. 3. The stamped blank 26 will be a predetermined shape and have louvers 16 and 18 formed therein. Simultaneously with the stamping process to form the stamped blank 26, support bracket attachment holes 28 are provided in each side of the stamped blank 26. Further, sill plate attachment holes 30 are also provided in each side of the stamped blank 26.

Figure 4:
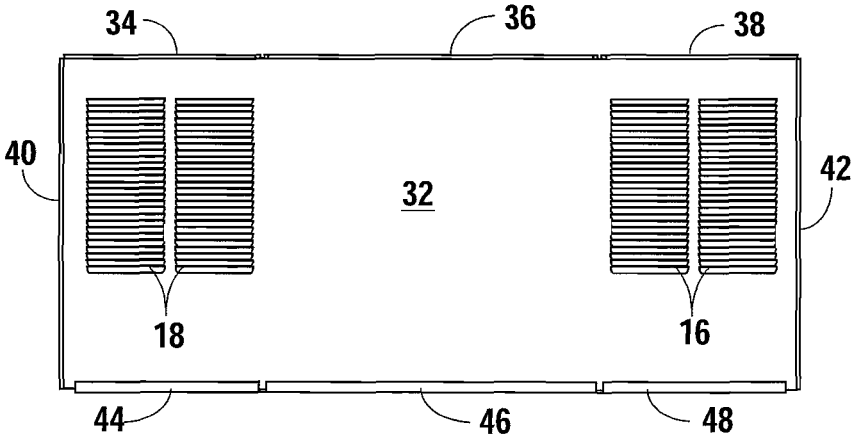
FIG. 4 is a stamped blank of a room air conditioner/heat pump with the outer flanges being formed.

The stamped blank 26 is formed in a press to have outer flanges there around as can be seen in the formed stamped blank 32 shown in FIG. 4. The formed stamped blank 32 has a back left-side flange 34, back top flange 36 and a back right-side flange 38. A left-side skid flange 40 and a right-side skid flange 42 are also formed on each end of the formed stamped blank 32. On the front of the formed stamped blank 32 is located a left front flange 44, a top front flange 46 and a right-side front flange 48. The front flanges 44, 46 and 48 are simply folded in for structural support and do not interfere with the insertion of the room air conditioner and/or heat pump (not shown).

Figure 5:
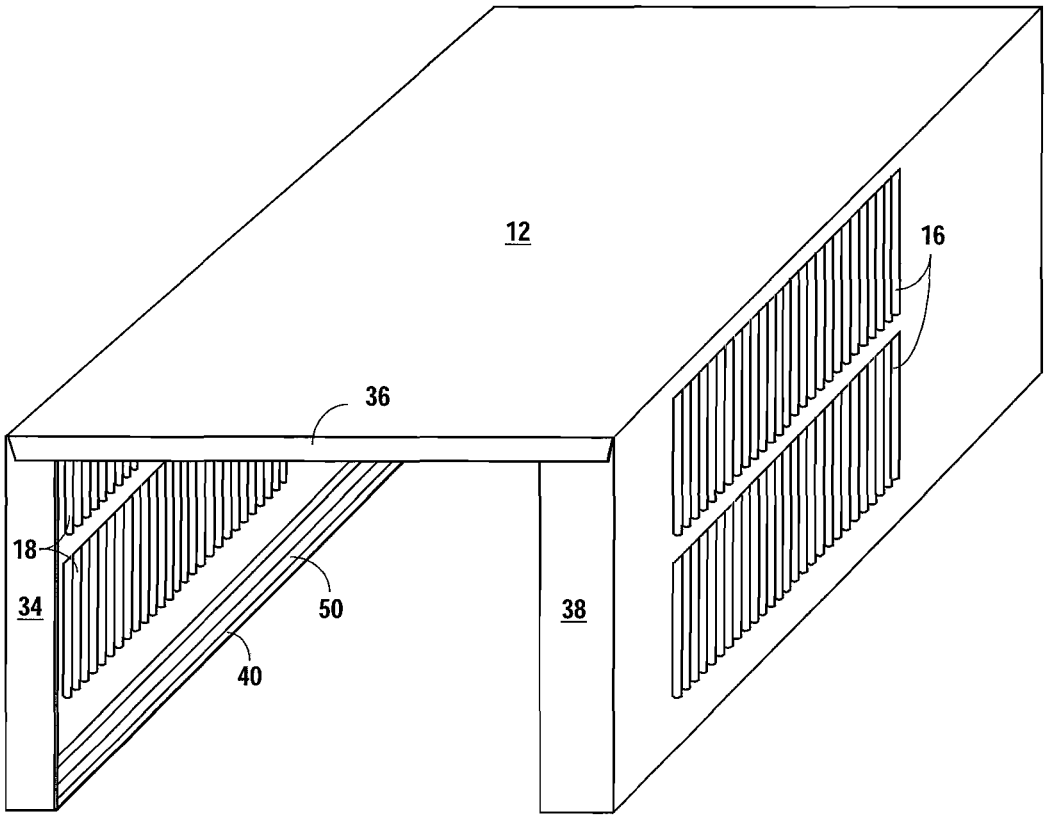
FIG. 5 is a perspective view of a U-shaped rectangular shell formed from the stamped blank for a room air conditioner/heat pump.

The formed stamped blank 32 is painted after stamping but before the final forming process as described herein below. The formed stamped blank 32 is folded to give a U-shaped rectangular shell 12 with open ends as shown in FIG. 5. In the folding process, back top flange 36 is outside of back left flange 34 and back right flange 38. Also, the left-side skid flange 40 has a ridge 50 formed therein so that the air conditioner/heat pump unit (not shown) will slide inside of the U-shaped rectangular shell 12 much easier.

Figure 6:
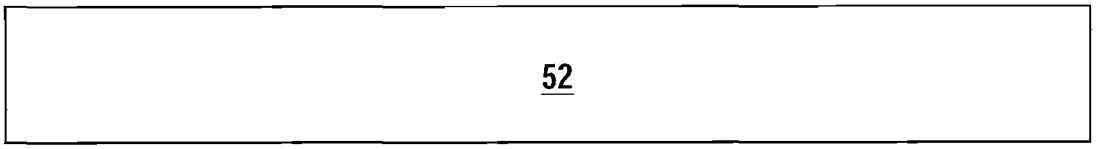
FIG. 6 is a blank of sheet metal for forming into a shell brace.
Figure 7:
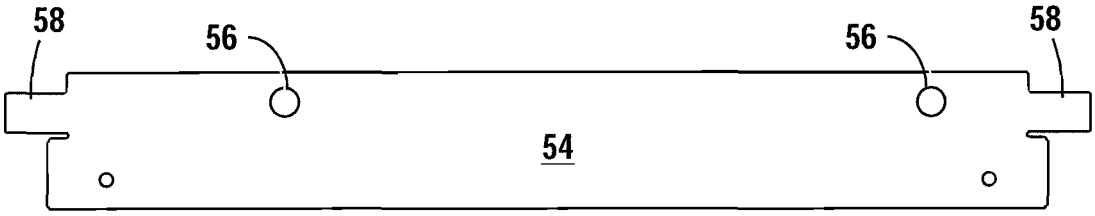
FIG. 7 is a stamped shell brace.

The forming of the shell brace 14, previously shown in FIG. 1, begins with a shell brace blank 52 of sheet metal as shown in FIG. 6. The shell brace blank 52 is stamped to give a shell brace stamped blank 54 as shown in FIG. 7. The shell brace stamped blank 54 has indentations 56 therein with tabs 58 on either rend thereof.

Figure 8:
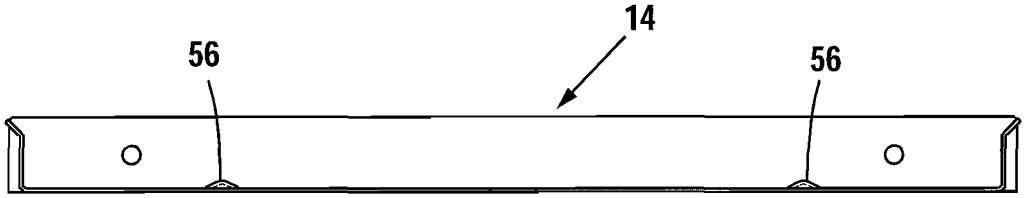
FIG. 8 is a stamped and folded shell brace.
Figure 9:
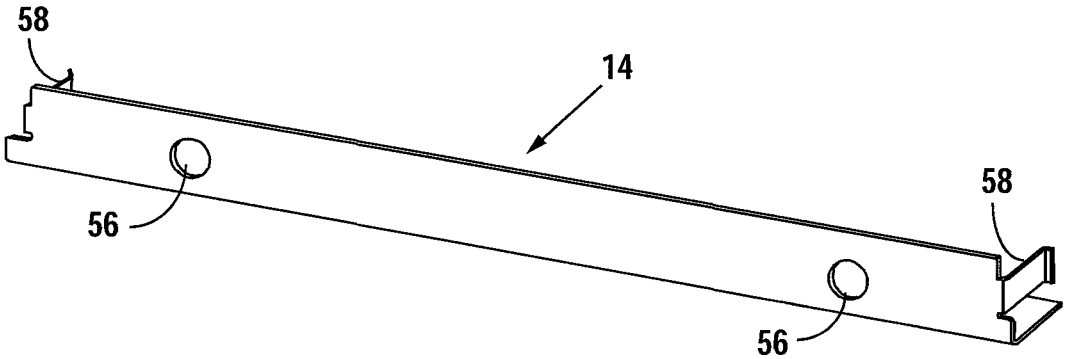
FIG. 9 is a perspective view of FIG. 8.

The shell brace stamped blank 54, as shown in FIG. 7, is then folded to put an angle in the shell brace 14 as shown in FIG. 8. A perspective view of the angled shell brace 14 is shown in FIG. 9 with the tabs 58 on either end thereof and the indentations 56. The U-shaped rectangular shell 12 is assembled with, but not connected to, the shell brace 14 as shown in FIG. 10.

Figure 11:
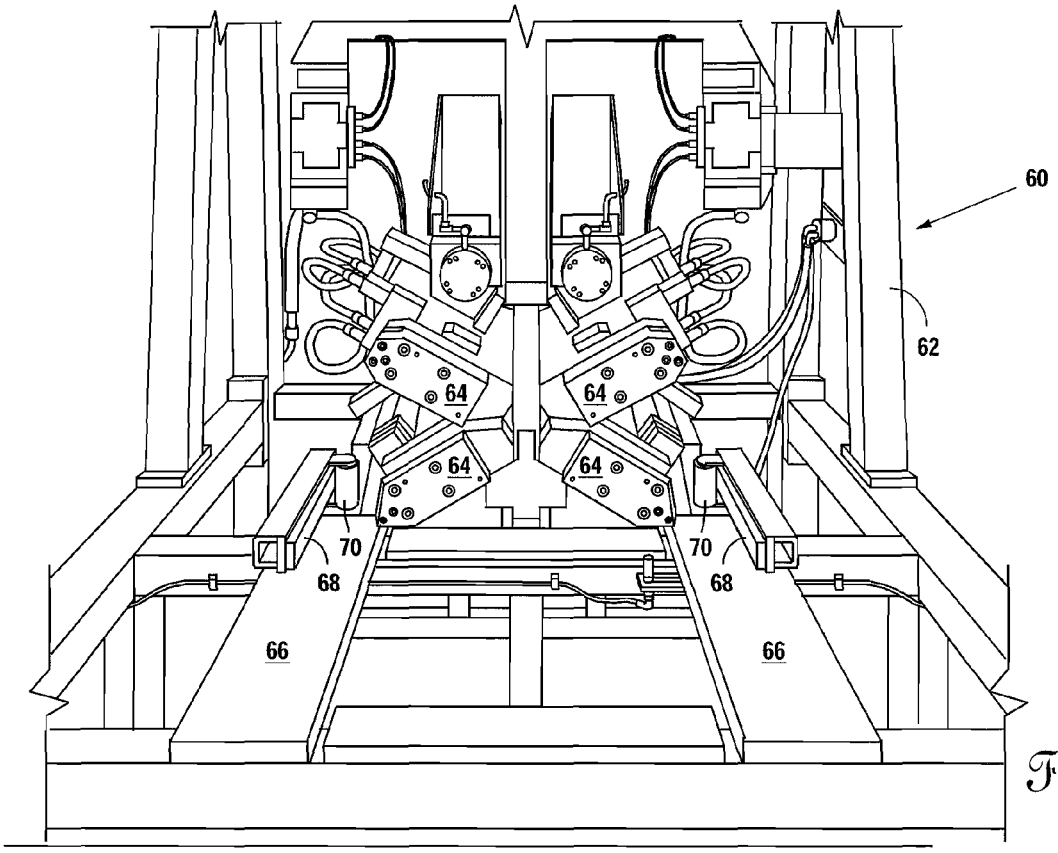
FIG. 11 is a perspective view of an assembly machine from an insertion side.

Referring now to FIG. 11, an assembly machine represented generally by the reference numeral 60 is shown. The assembly machine has a frame 62 on which is mounted hydraulic cylinders (not shown) connected to the heads 64. All of the heads 64 as shown in FIG. 11 are in the retracted position. Mounted on the frame 62 are support surfaces 66, guide rails 68 and stops 70. The assembly machine 60 can perform clinching of two pieces of sheet metal together similar to a process trademarked under the mark Tog-L-Loc®.

Figure 10:
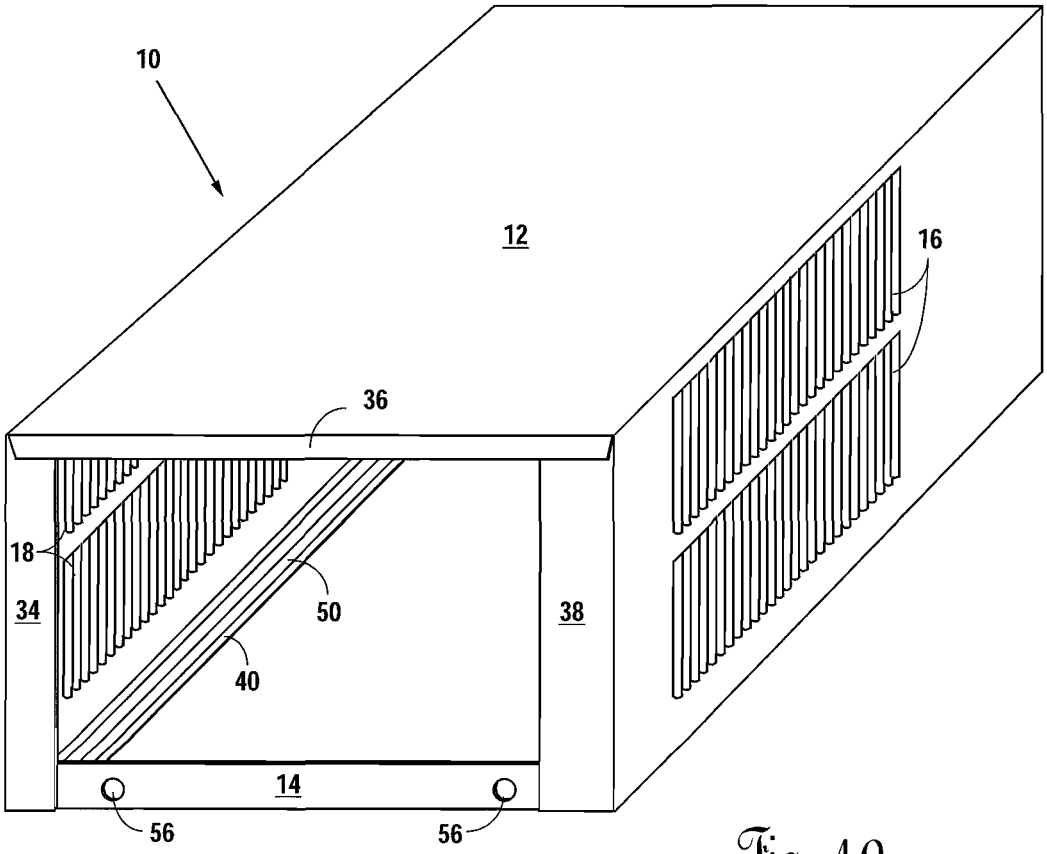
FIG. 10 is a perspective view of a shell for a room air conditioner/heat pump prior to insertion in an assembly machine.
Figure 12:
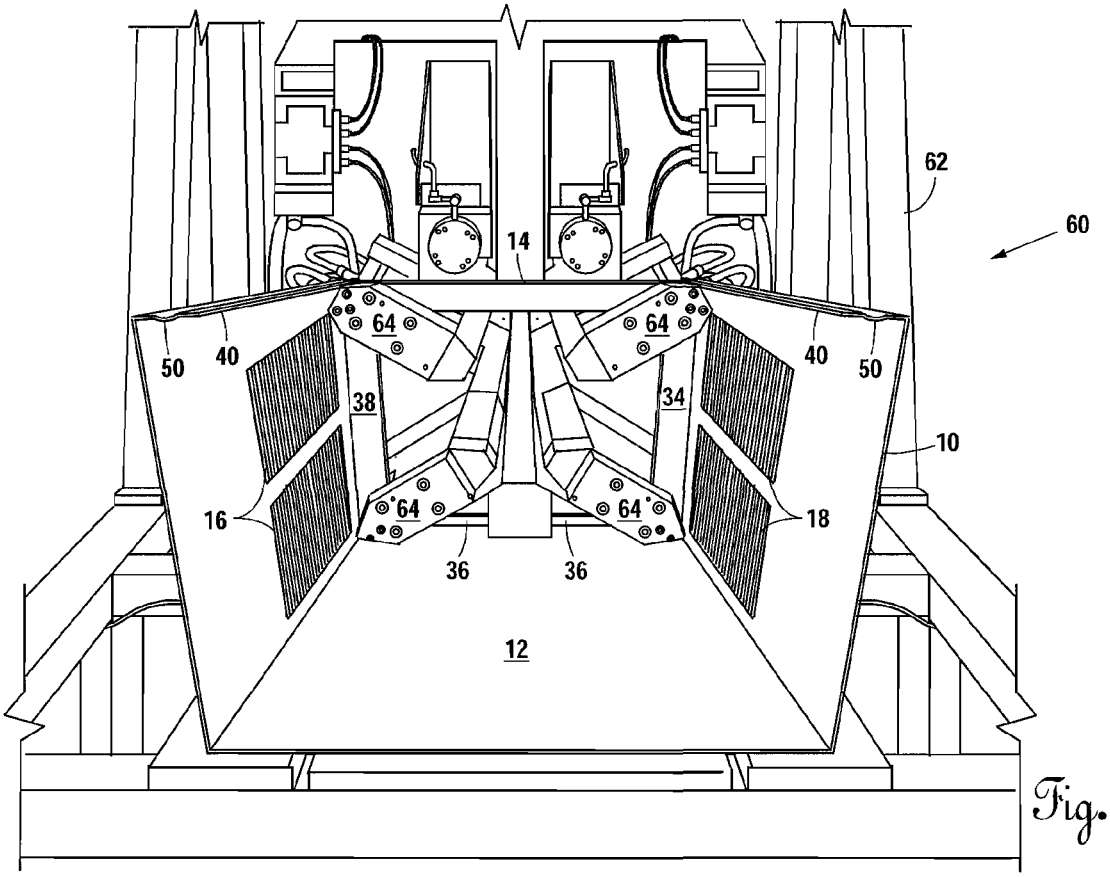
FIG. 12 is a perspective view of an assembly machine with a shell and shell brace inserted therein for assembly.

Referring now to FIG. 12, the shell of FIG. 10 is turned upside down and placed inside of the assembly machine 60 with shell brace 14 as shown. Each of the heads 64 moves outward to the corners of the U-shaped rectangular shell 12. The upper head 64 is pressed against the corner of the U-shaped rectangular shape 12 and the shell brace 14. The lower heads 64 are pressed against the overlapping flanges 34, 36 and 38. A clinching process similar to that marketed under the trademark Tog-L-Loc® is then performed by the assembly machine 60.

Figure 13:
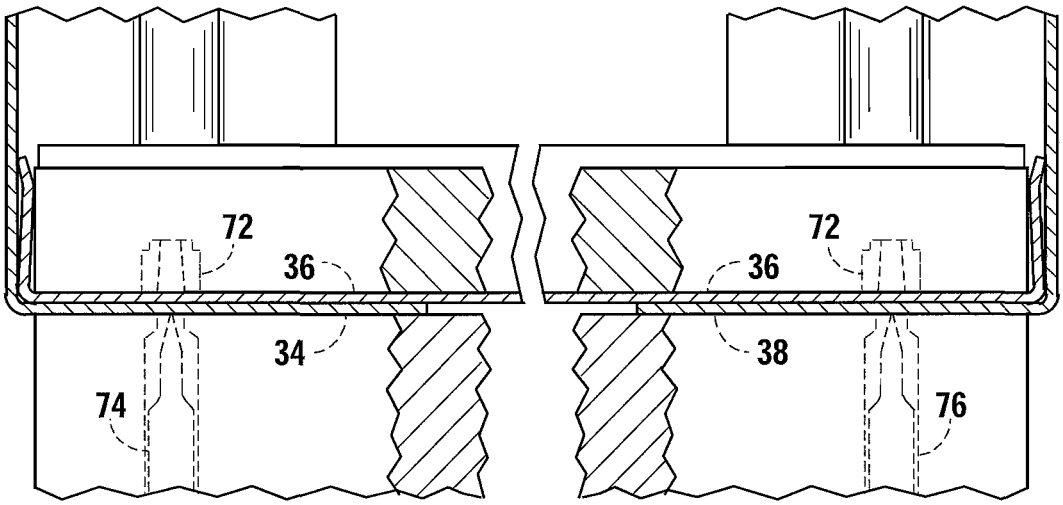
FIG. 13 is a cross-sectional view illustrating the position of a punch and die in corners of the shell immediately prior to punching.

Also, while the shell 10 is held in place inside of the assembly machine 60, the heads 64 will also hold a die in each corner. For purposes of illustration, assume that FIG. 13 is a cross-sectional view illustrating dies 72 being held in position by the two lower heads 64. Therefore, the dies 72 will be pressing against back top flange 36. On the outside of the shell 10, punch 74 will be resting against back left-side flange 34 and punch 76 will be resting against back right-side flange 38. There is a separate punch for each corner of the shell 10 and each head 64.

Figure 13A:
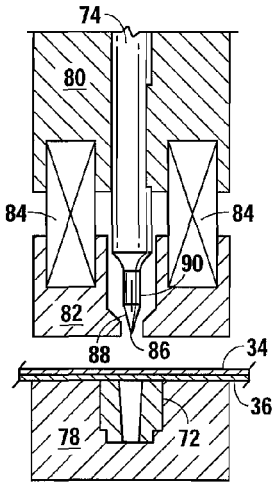
FIGS. 13A-13C are sequential views of the punch-and-die illustrating the punching process at each corner of the shell.

Using punch 74 as an example with die 72, the sequential operation will be explained in FIGS. 13A, 13B and 13C. A die holder 78 holds the die 72 in position against the back top flange 36. Outside the shell 10 and aligned with the die 72 is punch 74. Punch 74 is held in position by punch holder 80. Below the punch holder 80, towards the back left-side flange 34 is a stripper 82 connected by springs 84 to the punch holder 80. As shown in FIG. 13A, the punch 74, punch holder 80, and stripper 82 are not in contact with the back left-side flange 34.

Figure 13B:
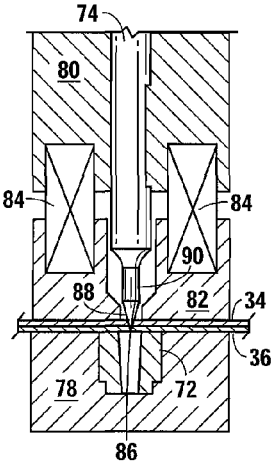

In the next sequential view, FIG. 13B, the stripper 82 is now in contact with the back left-side flange 34 and the tip 86 of the punch 74 has begun to penetrate the back left-side flange 34. As can be seen in each of the FIGS. 13A, 13B and 13C, the punch 74 has a tip 86 on the lower end thereof, followed by a conical section 88 and a cylindrical section 90. Also in FIG. 13B, the springs 84 are beginning to compress.

Figure 13C:
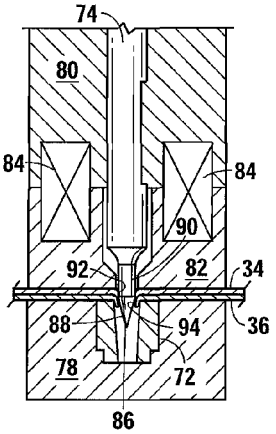

In FIG. 13C, the punch 74 has penetrated as much as possible because the punch holder 80 is now in abutting contact with the stripper 82. In FIG. 13C, punch 74 has penetrated to the point where the cylindrical section 90 has formed a cylindrical punched hole 92 in back left-side flange 34. However, in the back top flange 36, a conical punched hole 94 has been formed therein.

The conical punched hole 94 matches the conical shape of the conical section 88 of the punch 74. The cylindrical punched hole 92 is aligned with the conical punched hole 94. The conical section 88 is approximately 15° on either side of the centerline of punch 74 for a total 30° angle for conical punched hole 94 within a tolerance of plus or minus 5°.

Figure 14:
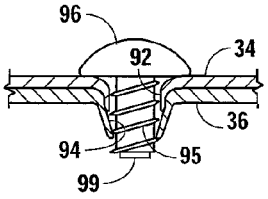
FIG. 14 is a cross-sectional view illustrating a screw engaging an innermost sheet metal, but not an outermost sheet metal.

After removal of the shell 10 from the assembly machine 60, screws 96 may be inserted through the back left-side flange 34 and threaded into the back top flange 36. The cylindrical punched hole 92 is slightly larger in diameter than the threads 95 of screw 96. However, the conical punched hole 94 in the back top flange 36 engage the threads 95 of screws 96 which pulls the back top flange 36 into a tight flush contact with the back left side flange 34 as shown in FIG. 14.

If the screw 96 were to threadably connect with both the back left-side flange 34 and the back top flange 36, a space may form there between which would weaken the structure. By having the screw only threadably connect with the innermost sheet metal, a tight flush relationship is formed between the two shaped pieces of sheet metal.

The same process as explained in FIGS. 13A-13C and 14 is performed at each corner of the U-shaped rectangular shell 12, joining either (a) overlapping flanges or (b) a flange and the shell brace 14.

Figure 15:
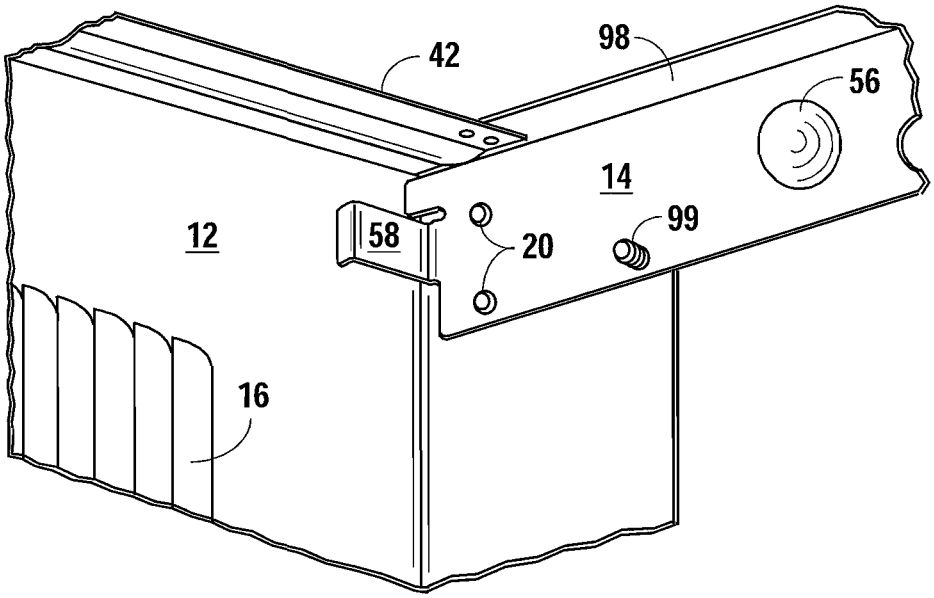
FIG. 15 is a perspective view from inside of the shell of a room air conditioner/heat pump illustrating the connection between the U-shaped rectangular shell and the shell brace.

FIG. 15 is looking from inside the U-shaped rectangular shell 12 out to show the connection between the U-shaped rectangular shell 12 and the shell brace 14. The shell brace 14 has an indentation 56 that will stop the rearward movement of the air conditioner/heat pump (not shown). The inner fold 98 of the shell brace 14 extends outside both the left-side skid flange (not shown) and the right-side skid flange 42. The tab 58 of the shell brace 14 presses against the inner wall of the U-shaped rectangular shell 12 so that the shell brace 14 and the U-shaped rectangular shell 12 will stay in position when being inserted into the assembly machine 60. Also visible in FIG. 15 is the clinching indentations 20. The end 99 of the screw 96 as it threadably connects with shell brace 14 is also visible in FIG. 15.

While the punching process has been explained in connection with the joining of sheet metal to form the shell 10 for an air conditioner/heat pump, the same punching process can be used for any housing made from punched and folded sheet metal to provide additional lateral strength. Spot welds or clinching have a tendency to break during exertion of lateral forces on a shell type housing. Such is not the case with punched holes and screw connections where the screw threads only into the innermost sheet metal.

What I claim is:

1. A method of manufacturing a generally rectangular shell from sheet metal for a room air conditioner/heat pump comprising the following steps:

stamping a first sheet metal blank to form a predetermined shaped shell with holes and louvers therein;

stamping a second sheet metal blank to form a predetermined shaped shell brace;

first forming flanges on outer edges of said shell;

second forming of said shell into a U-shaped rectangle with said outer edge overlapping at corners of said U-shaped rectangle;

painting said shell and said angle brace after said stamping step, but before the next step of inserting;

inserting said shell and said shell brace into an assembly machine wherein (a) said shell brace is secured across an open end of said U-shaped rectangle and (b) corners are punched through (1) said overlapping outer edges and (2) said flanges and said shell brace;

during said punching, a conical shaped punch on an end of a cylinder moves inward towards a die at each corner of said open end of said U-shaped rectangle so that an outermost layer of said flanges are punched at said each corner to form outer punched holes having a diameter approximately equal to said cylinder, but an innermost layer of said flange or shell brace is punched to form a conical shaped hole aligned with said outer punched hole;

inserting screws through said outer punched holes for threaded connection with said conical shaped holes, but not with said outer punched holes, to draw said innermost layer against said outermost layer, said screws providing lateral strength to said generally rectangular shell.

2. The method of manufacturing the generally rectangular shell from sheet metal as recited in claim 1 including between said stamping step and said inserting step a third forming of said shell brace to create an angle there along for added strength and tabs on each end thereof.

3. The method of manufacturing the generally rectangular shell from sheet metal as recited in claim 2 wherein as part of said inserting step corners of said U-shaped rectangle are secured by attaching (a) said overlapping outer edges and (b) said outer edge and said shell brace.

4. The method of manufacturing the generally rectangular shell from sheet metal as recited in claim 3 wherein said attaching is by clinching.

5. The method of manufacturing the generally rectangular shell from sheet metal as recited in claim 4 or 1 wherein said cylinder of said conical shaped punch is slightly larger in diameter than said screws.

6. The method of manufacturing the generally rectangular shell from sheet metal as recited in claim 5 wherein said punch and said die have a stop to prevent said cylinder of said conical shaped punch from penetrating said innermost layer of said flange or said shell brace.

7. The method of manufacturing the generally rectangular shell from sheet metal as recited in claim 6 wherein a punch holder positions said punch and holds said punch during said punching, a stripper positioned adjacent said punch holder for removing said punch after said punching.

8. The method of manufacturing the generally rectangular shell from sheet metal as recited in claim 7 wherein a die holder holds said die in position during said punching.

9. A method of joining sheet metal to form a shell with lateral strength to protect an object therein, comprising the following steps:

stamping the sheet metal to a predetermined shape;

first forming said stamped sheet metal to have flanges on an outer edge thereof, second forming of said stamped sheet metal into a container so that said flanges of said stamped and formed sheet metal overlap on at least one corner of said container to provide an inside flange and an outside flange;

securing a die against said inside flanges within said corner;

locating a punch adjacent to said die, but against said outside flanges, said punch having a conical section and a cylindrical section;

punching said outside flange to said cylindrical section to form a first hole of a predetermined diameter therein, but only punching said inside flange with said conical section to form a second, conical shaped hole therein;

inserting a screw through said first and second holes to threadably connect said inside flange at said conical shaped hole, said predetermined diameter being slightly larger than the diameter of said screw; and tightening said screw to draw said inside flange against said outside flange.

10. The method of joining sheet metal to form a shell with lateral strength as recited in claim 9, wherein said securing, locating and punching steps occur at each corner of said container.

11. The method of joining sheet metal to form a shell with lateral strength as recited in claim 9, wherein said sheet metal is painted after said stamping step, but before said punching step.

12. The method of joining sheet metal to form a shell with lateral strength as recited in claim 9, wherein said conical section is approximately 15° with respect to a centerline of said punch.

13. The method of joining sheet metal to form a shell with lateral strength as recited in claim 12 wherein said punch is held by a punch holder, a stripper being spring-loaded to said punch holder to remove said punch after said punching step.

14. The method of joining sheet metal to form a shell with lateral strength as recited in claim 13 wherein said conical section can vary plus or minus 5 degrees.

15. The method of joining sheet metal to form a shell with lateral strength as recited in claim 14 wherein said securing, locating and punching steps are performed inside an assembly machine.

16. The method of joining sheet metal to form a shell with lateral strength as recited in claim 15 wherein said outside flanges are clinched to said inside flanges.

17. The method of joining sheet metal to form a shell with lateral strength as recited in claim 16 wherein a cross brace is used versus said inside flange on one side of said container in the preceding steps.

* * * * *